US007946681B2

(12) United States Patent
Ohta

(10) Patent No.: US 7,946,681 B2
(45) Date of Patent: May 24, 2011

(54) NOZZLE PLATE, INK EJECTION HEAD, AND IMAGE FORMING APPARATUS

(75) Inventor: Hiroshi Ohta, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 357 days.

(21) Appl. No.: 12/056,830

(22) Filed: Mar. 27, 2008

(65) Prior Publication Data

US 2008/0239000 A1 Oct. 2, 2008

(30) Foreign Application Priority Data

Mar. 30, 2007 (JP) ..... 2007-095515

(51) Int. Cl.
*B41J 2/135* (2006.01)

(52) U.S. Cl. ..... 347/45; 347/44

(58) Field of Classification Search ..... 347/45
See application file for complete search history.

(56) References Cited

U.S. PATENT DOCUMENTS

2003/0030696 A1 * 2/2003 Sato et al. ..... 347/45

FOREIGN PATENT DOCUMENTS

JP 2001-328263 * 11/2001
JP 2001-328263 A 11/2001

* cited by examiner

*Primary Examiner* — Uyen-Chau N Le
*Assistant Examiner* — Kajli Prince
(74) *Attorney, Agent, or Firm* — Birch, Stewart, Kolasch & Birch, LLP

(57) ABSTRACT

A nozzle plate includes: a plate substrate in which a nozzle is formed, ink being ejected through an ejection port of the nozzle in the plate substrate; and a p-type doped layer which forms a whole perimeter of an edge portion defining an inner perimeter of the ejection port of the nozzle in the plate substrate.

4 Claims, 11 Drawing Sheets

NOZZLE PLATE, INK EJECTION HEAD, AND IMAGE FORMING APPARATUS

BACKGROUND OF THE INVENTION

1. Field of the Invention

The present invention relates to a nozzle plate, an ink ejection head and an image forming apparatus, and more particularly, to a nozzle plate arranged in a recording head in an inkjet printer.

2. Description of the Related Art

In general, the inkjet printer uses alkaline ink, and the inkjet printer has an inkjet head constituted of a silicon substrate, which has a low resistance to alkali.

Japanese Patent Application Publication No. 2001-328263 discloses an inkjet head in which inner faces of a pressure chamber are formed in a silicon substrate and a face of a diaphragm facing the pressure chamber is also formed in the silicon substrate. Since the faces of the pressure chamber and the diaphragm make contact with the ink, then they are made resistant to alkali by being formed with a p-type doped layer on them.

However, in Japanese Patent Application Publication No. 2001-328263, the p-type doped layer is not formed on the nozzle plate. Then, edge portions that define ejection ports of nozzles in the nozzle plate do not have ink resistant properties, and it is not possible to maintain the dimensional accuracy of the ejection ports of the nozzles.

Moreover, in a case where a liquid repelling film is arranged on an ejection surface, which is the surface of the nozzle plate where the ejection ports of the nozzles are formed, the liquid repelling layer may be bonded on an oxide layer formed on the surface of the silicon substrate constituting the main body of the nozzle plate. In this case, since the bonding region between the oxide layer and the liquid repelling layer is exposed on the inner surface of the nozzle, then ink permeates through the bonding region, and there is a risk that the liquid repelling layer may peel away from the oxide layer formed on the silicon substrate.

SUMMARY OF THE INVENTION

The present invention has been contrived in view of these circumstances, an object thereof being to provide a nozzle plate which prevents peeling away of the liquid repelling layer formed on the ejection surface of the nozzle plate, as well as maintaining shape and dimensional accuracy, by providing ink resistant properties in the perimeter of the ejection ports of the nozzles of the nozzle plate.

In order to attain the aforementioned object, the present invention is directed to a nozzle plate, comprising: a plate substrate in which a nozzle is formed, ink being ejected through an ejection port of the nozzle in the plate substrate; and a p-type doped layer which forms a whole perimeter of an edge portion defining an inner perimeter of the ejection port of the nozzle in the plate substrate.

According to this aspect of the present invention, since the p-type doped layer is formed at least about the whole circumference of the edge section that defines the inner perimeter of the ejection port of the nozzle, then the alkali resistance of the edge section of the nozzle is improved by the p-type doped layer, and it is possible to maintain the dimensional accuracy of the edge section of the nozzle. Moreover, since the wear resistance is improved by the presence of the p-type doped layer, the durability of the ejection port of the nozzle with respect to wiping is improved, and it is possible to maintain the dimensional accuracy of the edge section of the nozzle.

Furthermore, by forming the p-type doped layer on the inner surface of the nozzle as well, the alkali resistance of the inner surface of the nozzle is improved, and the dimensional accuracy of the inner surface of the nozzle can be maintained.

In order to attain the aforementioned object, the present invention is also directed to a nozzle plate, comprising: a plate substrate; an oxide layer which is formed on the plate substrate; a liquid repelling layer which is formed on the oxide layer; a nozzle which is formed through the plate substrate, the oxide layer and the liquid repelling layer, ink being ejected through an ejection port of the nozzle in the liquid repelling layer; and a p-type doped layer which forms a whole perimeter of an edge portion defining an inner perimeter of the ejection port of the nozzle in the liquid repelling layer, and forms a region from the edge portion through a boundary portion between the oxide layer and the liquid repelling layer on an inner surface of the nozzle.

According to this aspect of the present invention, since the p-type doped layer is formed on the inner surface of the nozzle, the alkali resistance of the inner surface of the nozzle is improved, and the dimensional accuracy of the inner surface of the nozzle can be maintained. Moreover, the ink wetting properties of the inner surface of the nozzle are improved by the p-type doped layer, and incorporation of air bubbles to the ink through the ink ejection port of the nozzle is not liable to occur. Furthermore, since the p-type doped layer is formed over the range from the edge section of the ink ejection port to the position of the boundary region between the oxide layer and the liquid repelling layer on the inner surface of the nozzle, then the boundary region of the oxide layer and the liquid repelling layer is covered with the p-type doped layer and does not face directly onto the nozzle, and hence the ink does not permeate into the boundary region of the oxide layer and the liquid repelling layer and there is no risk of the liquid repelling layer peeling away from the oxide layer.

Preferably, the p-type doped layer has a thickness, from the inner surface of the nozzle, not smaller than 2 μm and not larger than 10 μm.

According to this aspect of the present invention, by more reliably providing ink resistance properties in the perimeter of the ejection port of the nozzle, maintenance of the shape and dimensional accuracy can be achieved. Furthermore, it is possible to prevent peeling away of the liquid repelling layer, in a more reliable fashion.

In order to attain the aforementioned object, the present invention is also directed to an ink ejection head, comprising the above-described nozzle plate.

In order to attain the aforementioned object, the present invention is also directed to an image forming apparatus, comprising the above-described ink ejection head.

According to the present invention, by providing ink resistance properties in the perimeter of the ejection port of the nozzle in the nozzle plate, the shape and dimensional accuracy can be maintained, and it is possible to prevent the liquid repelling layer formed on the ejection surface of the nozzle plate from peeling away.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Description of Nozzle Plate

Figure 1A:
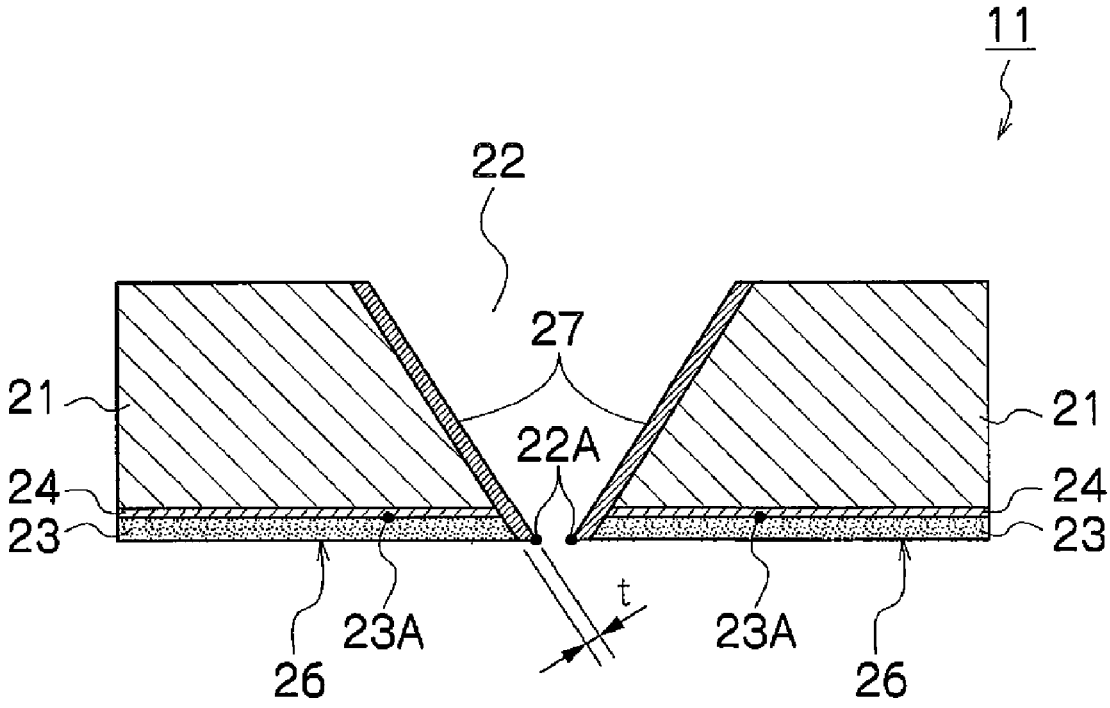
FIG. 1A is a cross-sectional diagram in an ink ejection direction of the vicinity of a nozzle in a nozzle plate according to an embodiment of the present invention.
Figure 1B:
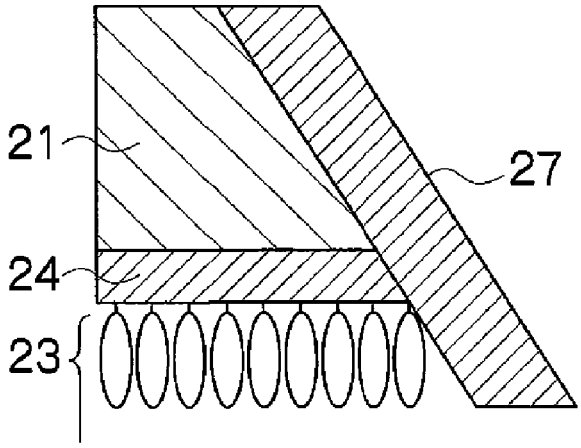
FIG. 1B is an enlarged diagram of a bonding section between a liquid repelling film and an oxide layer.

FIG. 1A is a cross-sectional diagram of a nozzle plate 11 according to an embodiment of the present invention, in the ink ejection direction in the vicinity of a nozzle 22. FIG. 1B is an enlarged diagram of the bonding region between a liquid repelling layer 23 and an oxide layer 24.

As shown in FIG. 1A, the nozzle plate 11 includes a plate substrate 21, the nozzle 22, the liquid repelling layer 23, the oxide layer 24, and a p-type doped layer 27. The plate substrate 21 is a plate-shaped silicon substrate. The nozzle 22 is formed in such a manner that the internal diameter thereof narrows toward the ink ejection direction, and thus the nozzle 22 tapers in the ink ejection direction. The nozzle 22 has an edge portion 22A of the inner perimeter of the ink ejection port at the endmost portion of the tapering shape.

It is one of the characteristic features of the present embodiment that the p-type doped layer 27 is formed about the whole perimeter of the edge portion 22A. The nozzle 22 is not limited to having the tapering shape when viewed in cross-section in the ink ejection direction, and it may have a parallel shape.

A surface of the liquid repelling layer 23 is bonded to the oxide layer 24 formed over the plate substrate 21, and the other surface of the liquid repelling layer 23 constitutes an ink ejection surface 26 along with the p-type doped layer 27. When a bonding region 23A, which is the boundary region between the liquid repelling layer 23 and the oxide layer 24, is enlarged, then as shown in FIG. 1B, a state is seen where a large number of molecules of the liquid repelling layer 23 have become bonded with the oxide layer 24. The oxide layer 24 is formed by oxidizing the surface of the plate substrate 21.

It is one of the characteristic features of the present embodiment that the p-type doped layer 27 is formed on the inner surface of the nozzle 22. Thus, the alkali resistance of the inner surface of the nozzle 22 is improved, and the dimensional accuracy of the inner surface of the nozzle 22 can be maintained. Moreover, the ink wetting properties of the inner surface of the nozzle 22 are also improved by the p-type doped layer 27, and incorporation of air bubbles to the ink through the ink ejection port of the nozzle 22 is not liable to occur.

Furthermore, the p-type doped layer 27 is also formed over a range from the edge portion 22A to the bonding section 23A between the oxide layer 24 and the liquid repelling layer 23 on the inner surface of the nozzle 22. Thus, the bonding section 23A between the liquid repelling layer 23 and the oxide layer 24 is covered with the p-type doped layer 27 and does not face directly onto the nozzle 22, then the ink inside the nozzle 22 does not penetrate into the bonding section 23A.

When the p-type doped layer 27 is made with boron as described later, it is sufficient to dope the silicon surface with boron at a concentration of approximately $10^{20}$ atoms/$cm^3$ or above, at a thickness of t=2 μm. As shown in FIG. 1A, the thickness t is the distance from the inner surface of the nozzle 22 to the contact surface with the plate substrate 21, the oxide layer 24 and the liquid repelling layer 23.

Figure 2A:
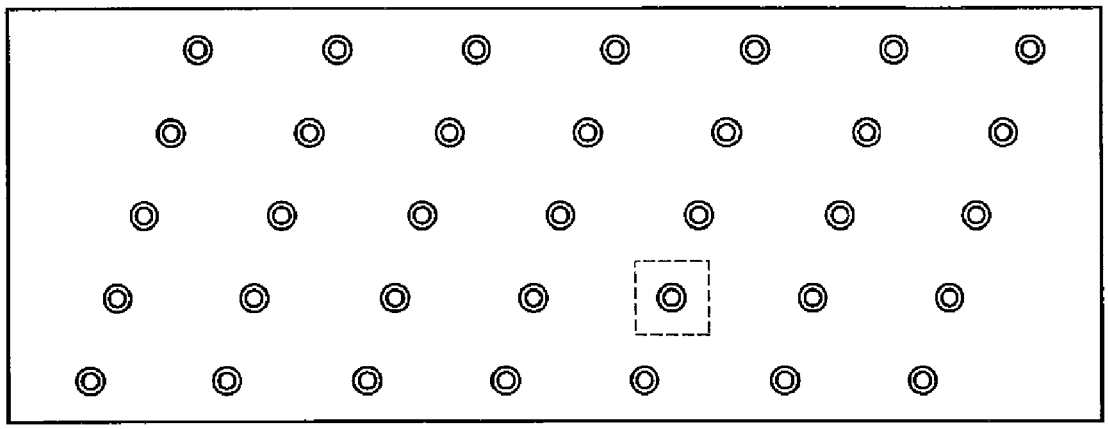
FIG. 2A is an external diagram of the nozzle plate according to the present embodiment, as viewed from the side of an ink ejection surface.

FIG. 2A is an external diagram of the nozzle plate 11 in the present embodiment as viewed from the side of the ink ejection surface 26. As shown in FIG. 2A, the ejection ports of the nozzles 22 are arranged in a matrix configuration.

Figure 2B:
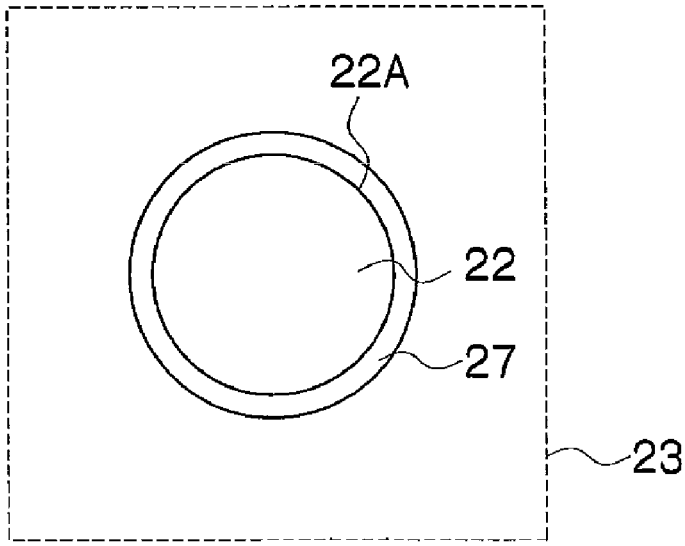
FIG. 2B is an enlarged diagram of the vicinity of one nozzle which is surrounded by a broken line in FIG. 2A.

FIG. 2B is an enlarged diagram of the vicinity of one of the nozzles 22, which is enclosed by a broken line in FIG. 2A. As shown in FIG. 2B, the ink ejection surface 26 has the p-type doped layer 27 formed around the ejection port of the nozzle 22, and the liquid repelling layer 23 formed around the p-type doped layer 27.

Next, the method of manufacturing the nozzle plate according to an embodiment of the present invention is described. FIGS. 3A to 3J are step diagrams of the method of manufacturing the nozzle plate according to the present embodiment.

Figure 3A:
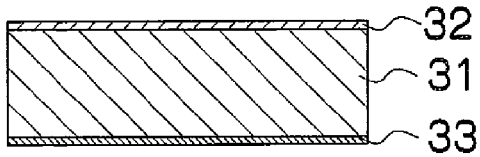
FIGS. 3A to 3J are step diagrams of a method of manufacturing a nozzle plate according to the present embodiment.

As shown in FIG. 3A, mask layers 32 and 33 are formed on both surfaces of a silicon substrate 31, which is to constitute the plate substrate 21 in the manufactured nozzle plate 11. The mask layer 32 is formed on the surface that is not to serve as the ink ejection surface 26 in the manufactured nozzle plate 11, and the mask layer 33 is formed on the surface that is to serve as the ink ejection surface 26 in the manufactured nozzle plate 11. The thickness of the silicon substrate 31 is 50 μm to 100 μm. The mask layer 32 is used as a mask for an etching step and also for a subsequent doping step, and the mask layer 32 must be resistant to temperature rise and must not allow the ions to pass through to the silicon substrate 31 or allow particles to exit. Hence, it is desirable to use a silicon oxide layer for the mask layers 32 and 33.

Figure 3B:
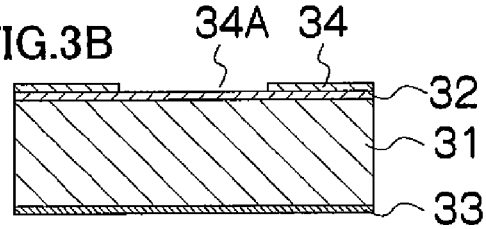

Next, as shown in FIG. 3B, a resist pattern 34 in which an aperture 34A is formed is arranged over the mask layer 32. The inner diameter of the aperture 34A is set to be equivalent to the inner diameter of a supply port of the nozzle 22 on a side opposite to the ejection port in the manufactured nozzle plate 11.

Figure 3C:
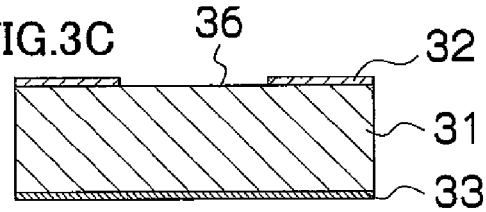

Subsequently, as shown in FIG. 3C, a mask aperture 36 having the inner diameter equivalent to the inner diameter of the supply port of the nozzle 22 is formed in the mask layer 32, and the resist pattern 34 is then removed.

Figure 3D:
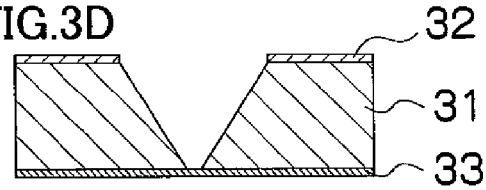

Thereupon, as shown in FIG. 3D, the silicon substrate 31 is etched through the mask aperture 36 and a hole for the nozzle 22 is formed. The etching may be performed by dry etching or by wet etching. In the present embodiment, anisotropic etching with a potassium hydroxide (KOH) solution is carried out. In this case, a silicon substrate having a (100) surface is used as the silicon substrate 31. Etching ends when the mask layer 33 on the side of the ink ejection surface 26 has been reached.

Figure 3E:
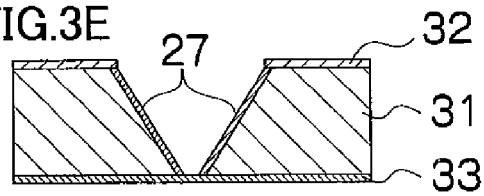

Thereupon, as shown in FIG. 3E, the inner surface of the hole formed in the silicon substrate 31 is doped with a p-type dopant with using the mask aperture 36 also used in the etching step, thereby forming the p-type doped layer 27. Boron (B), for example, can be used as the p-type dopant.

Figure 4:
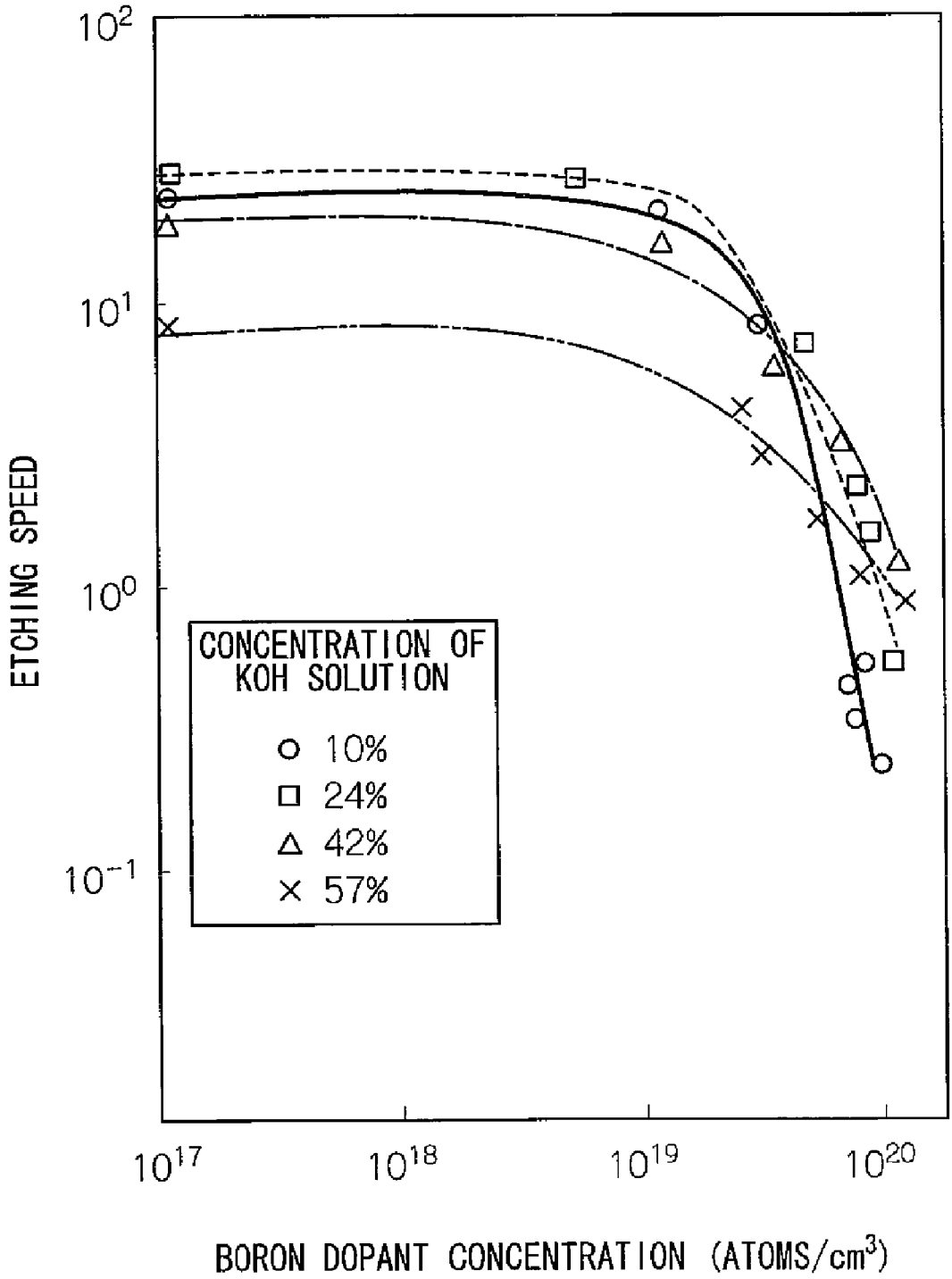
FIG. 4 is a graph showing the relationship between the boron dopant concentration and the alkali resistance properties of the silicon surface.

Here, the thickness t (see FIGS. 1A and 1B) and the dopant concentration of the p-type doped layer 27 are described. The relationship between the boron dopant concentration and the alkali resistance of the silicon surface is illustrated in FIG. 4, in relation to an example where a potassium hydroxide solution is used as a strong alkali liquid. In FIG. 4, the horizontal axis indicates the boron dopant concentration (atoms/$cm^3$) and the vertical axis indicates the etching speed with the potassium hydroxide solution. Results are shown for cases where the concentration of the potassium hydroxide solution is 10%, 24%, 42% and 57%. In general terms, the etching speed starts to decline when the boron dopant concentration has exceeded $10^{19}$ atoms/$cm^3$, and in particular, in the case of the liquid having a 10% concentration of potassium hydroxide, the etching speed at the boron dopant concentration of $10^{20}$ atoms/$cm^3$ is 1/100 of the etching speed at the boron dopant concentration of $10^{17}$ atoms/$cm^3$ (in other words, the alkali resistance of the silicon surface with the boron dopant concentration of $10^{20}$ atoms/$cm^3$ is 100 times greater than the silicon surface with the boron dopant concentration of $10^{17}$ atoms/$cm^3$).

Since normal ink does not have alkali properties as strong as those of potassium hydroxide, then satisfactory resistance to alkali can be expected with respect to ink, even at lower boron dopant concentrations. Hence, in order to improve the resistance of the nozzle 22 to alkaline ink, which is the object of the present invention, if the p-type doped layer 27 is made with boron, then it is sufficient to dope the silicon surface with boron at a concentration of $10^{20}$ atoms/$cm^3$ or above, at a thickness of t=2 μm, for example. The dopant concentration of the p-type doped layer 27 declines progressively in the thickness (depth) direction. Then, if the position where the thickness t=2 μm has the high dopant concentration of $10^{20}$ atoms/$cm^3$ or above, then as far as possible, it is desirable to form the p-type doped layer 27 at the dopant concentration whereby resistance to alkali can be expected up to a thickness of t=10 μm. Consequently, the recommended thickness t is 2 μm through 10 μm, provided that the p-type doped layer 27 has the dopant concentration that can be expected to give resistance to alkali.

Figure 5:
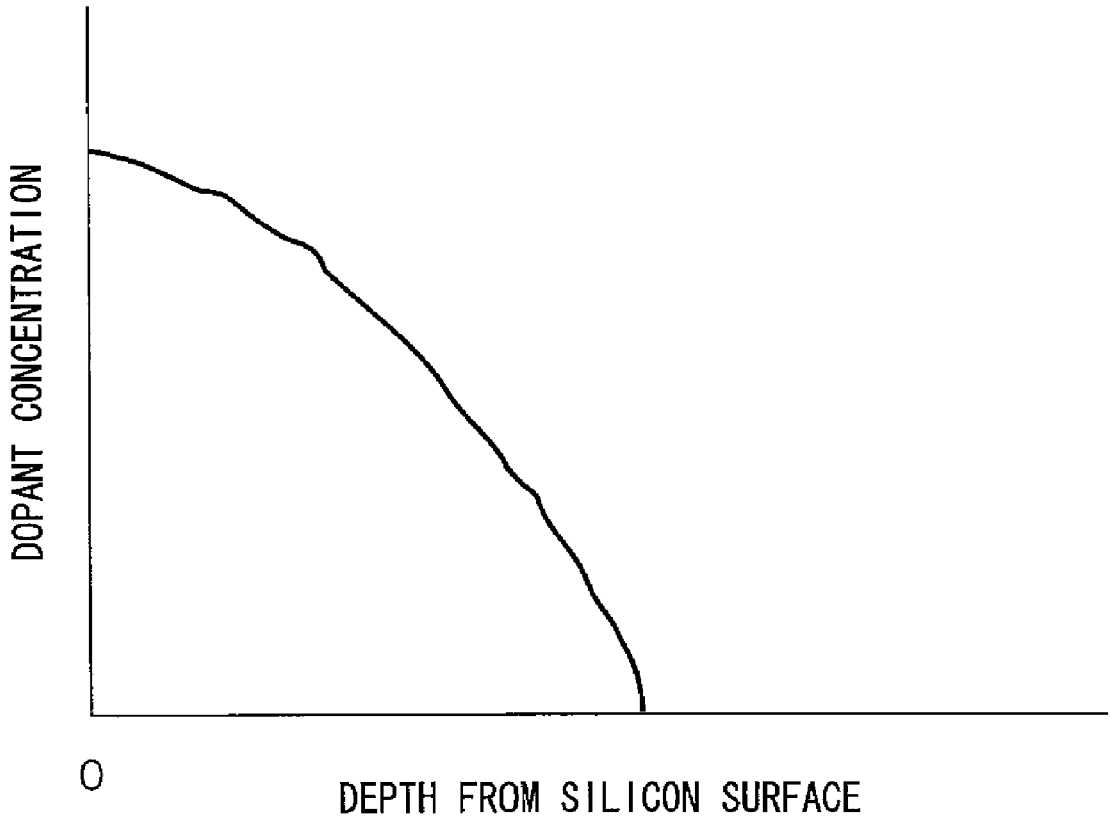
FIG. 5 is a schematic drawing of the dopant concentration based on a thermal diffusion method.

As the doping method, a thermal diffusion method, an ion injection method, or the like, can be used, and the thermal diffusion method is most desirable since it produces the highest dopant concentration on the outermost surface, which makes contact with the ink. FIG. 5 shows a schematic diagram of the dopant concentration achieved by means of the thermal diffusion method. The dopant concentration is highest at the surface and declines as the depth from the surface of the silicon increases.

For example, if the diffusion is carried out for one hour at 1150° C. using a solid thermal diffusion method, then a doped layer having the dopant concentration of $2\times10^{20}$ atoms/$cm^3$ in the surface region and the dopant concentration of $1\times10^{20}$ atoms/$cm^3$ in the region at the thickness of t=2 μm is obtained. Thus, the doped layer is formed over the inner surface of the nozzle 22 with the p-type dopant to the thickness of approximately 2 μm (with the dopant concentration of $10^{20}$ atoms/$cm^3$ or above). It is also possible to form the doped layer on the whole of the inner surface of a flow channel member, after bonding the silicon substrate with the flow channel member.

Figure 3F:
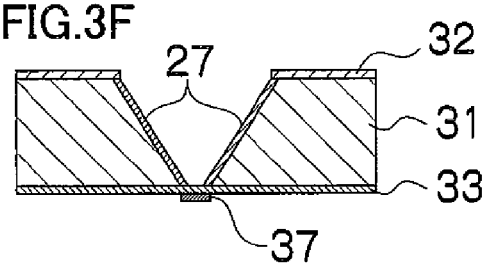

Thereupon, as shown in FIG. 3F, a resist pattern 37 is formed on the mask layer 33 on the side adjacent to the ink ejection surface 26. The width of the resist pattern 37 is equivalent to the external diameter of the p-type doped layer 27 on the ink ejection surface 26 in the manufactured nozzle plate 11.

Figure 3G:
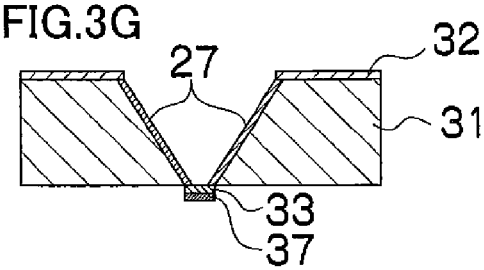

Next, as shown in FIG. 3G, the mask layer 33 other than the portion covered with the resist pattern 37 is removed by etching.

Figure 3H:
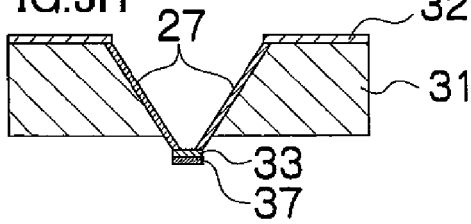

Next, as shown in FIG. 3H, the silicon substrate 31 is subjected to etching, from the surface on the side where the mask layer 33 is disposed toward the surface on the side where the mask layer 32 is disposed. The amount of etching is taken to be 0.1 μm. Thereby, on the surface where the mask layer 33 is disposed, a step difference of 0.1 μm is formed between the p-type doped layer 27 and the silicon substrate 31.

Figure 3I:
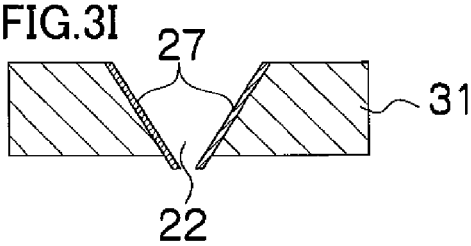

Next, as shown in FIG. 3I, the resist pattern 37 and the mask layers 32 and 33 are removed, thereby forming the nozzle 22.

Figure 3J:
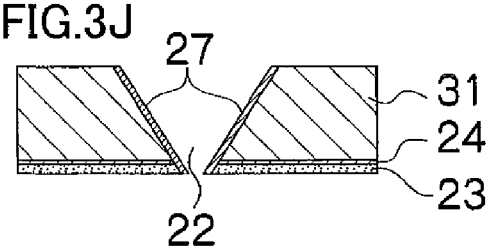

Subsequently, as shown in FIG. 3J, the surface of the silicon substrate 31 in the portion that has been lowered by 0.1 μm due to the formation of the step difference is oxidized, thereby forming the silicon oxide layer 24, and the liquid repelling layer 23 is formed thereon. The method of forming the liquid repelling layer 23 may involve silane coupling of fluoroalkylsilane, for example, with molecular vapor deposition (MVD) or a liquid phase method. The thus formed silicon substrate 31 serves as the plate substrate 21.

It is possible to obtain the beneficial effects described below by means of the nozzle plate 11 according to the above-described embodiment.

Firstly, in the nozzle plate 1 formed with the nozzle 22, the whole circumference of at least the edge portion 22A that defines the inner perimeter of the ejection port of the nozzle 22 is formed of the p-type doped layer 27, then the alkali resistance of the edge portion 22A of the nozzle 22 is improved, corrosion by the alkaline ink is prevented, and it is possible to maintain the acute-angled shape of the edge portion 22A of the nozzle 22 and the dimensional accuracy of the internal diameter of same. Therefore, it is possible to achieve the stable state of ejection.

Moreover, the wear resistance of the edge portion 22A of the nozzle 22 is also improved, the durability with respect to wiping of the ink ejection surface 26, which is carried out during maintenance, or the like, is improved, and the acute-angled shape and the dimensional accuracy of the internal diameter of the edge portion 22A of the nozzle 22 can be maintained. Therefore, it is possible to achieve the stable state of ejection.

The ejection port of the nozzle 22 is formed on the ink ejection surface 26 in the present embodiment; however, the present invention is not limited to this. For example, it is also possible that the ejection port of the nozzle 22 is formed on a counterbored surface formed in the ink ejection surface 26.

Further, since the p-type doped layer 27 is formed on the inner surface of the nozzle 22, then the ink wetting properties of the inner surface of the nozzle 22 are improved, and no air bubbles become incorporated in the ink through the ejection port of the nozzle 22.

Furthermore, in the nozzle plate 11 in which the oxide layer 24 is formed over the plate substrate 21, the liquid repelling layer 23 is formed over the oxide layer 24, and the nozzle 22 for ejecting the ink is formed so as to pass through the plate substrate 21, the oxide layer 24 and the liquid repelling layer 23 as shown in FIG. 1A, since the whole circumference of the edge portion 22A that defines the inner circumference of the ejection port of the nozzle 22 in the liquid repelling layer 23 is formed of the p-type doped layer 27, and furthermore since at least the region from the edge portion 22A through the bonding portion 23A between the oxide layer 24 and the liquid repelling layer 23 on the inner surface of the nozzle 22 is also formed of the p-type doped layer 27, then the bonding portion 23A between the liquid repelling layer 23 and the oxide layer 24 is covered with the p-type doped layer 27 and does not face directly onto the nozzle 22, and then the ink inside the nozzle 22 does not penetrate into the bonding region 23A and there is no risk of the liquid repelling layer 23 peeling away from the oxide layer 24.

Moreover, by making the thickness t of the p-type doped layer 27 not smaller than 2 μm and not larger than 10 μm, then the alkali resistance properties are imparted more reliably to the perimeter of the ejection port of the nozzle 22, and therefore the shape and dimensional accuracy can be maintained. Furthermore, it is possible to prevent peeling away of the liquid repelling layer 23, more reliably.

Structure of Head

Next, the structure of the ink ejection head (hereinafter, called "head") having the nozzle plate according to the embodiment of the present invention is described. The heads 112K, 112C, 112M and 112Y of the respective colors described below each have the same structure. Then, in the following explanation, the reference numeral 50 is used to indicate a head that is a representative example of these heads.

Figure 6A:
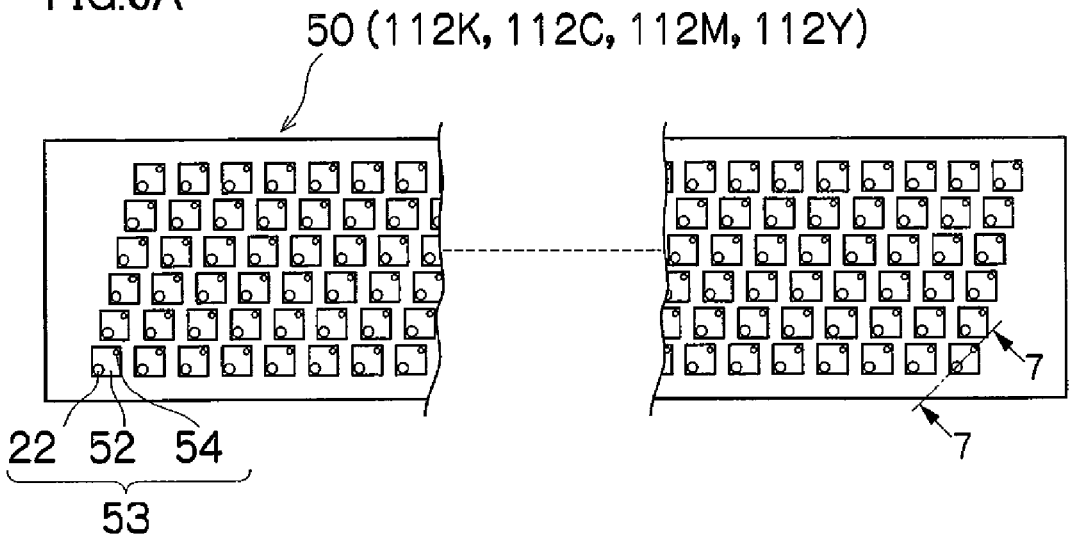
FIG. 6A is a plan view perspective diagram showing an embodiment of the structure of a head.
Figure 6B:
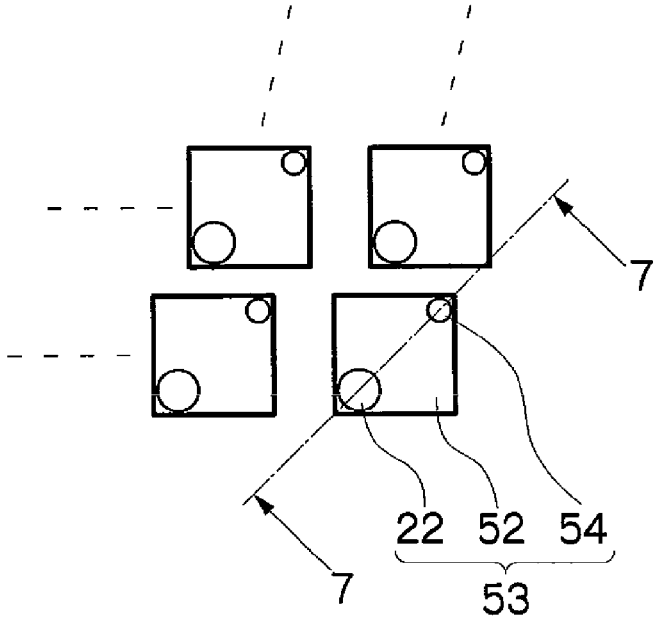
FIG. 6B is an enlarged diagram showing a portion of the head.
Figure 6C:
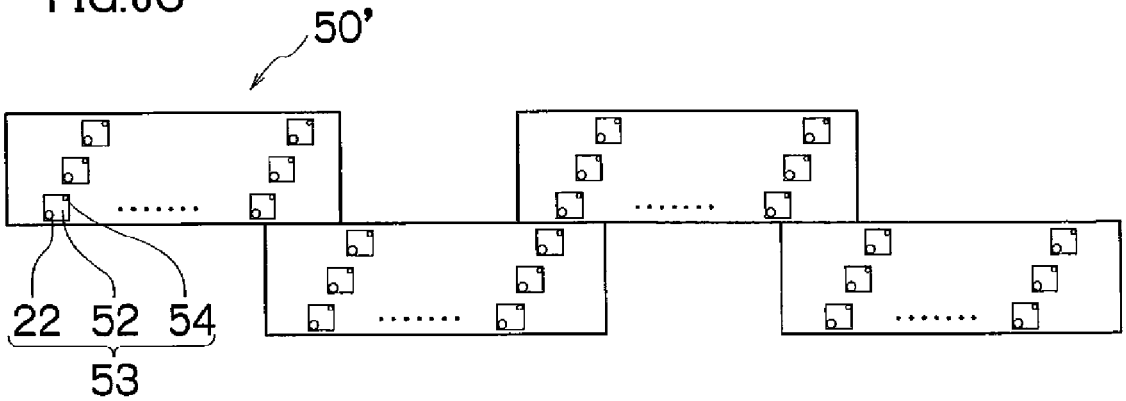
FIG. 6C is a plan view perspective diagram showing another embodiment of the structure of a head.
Figure 7:
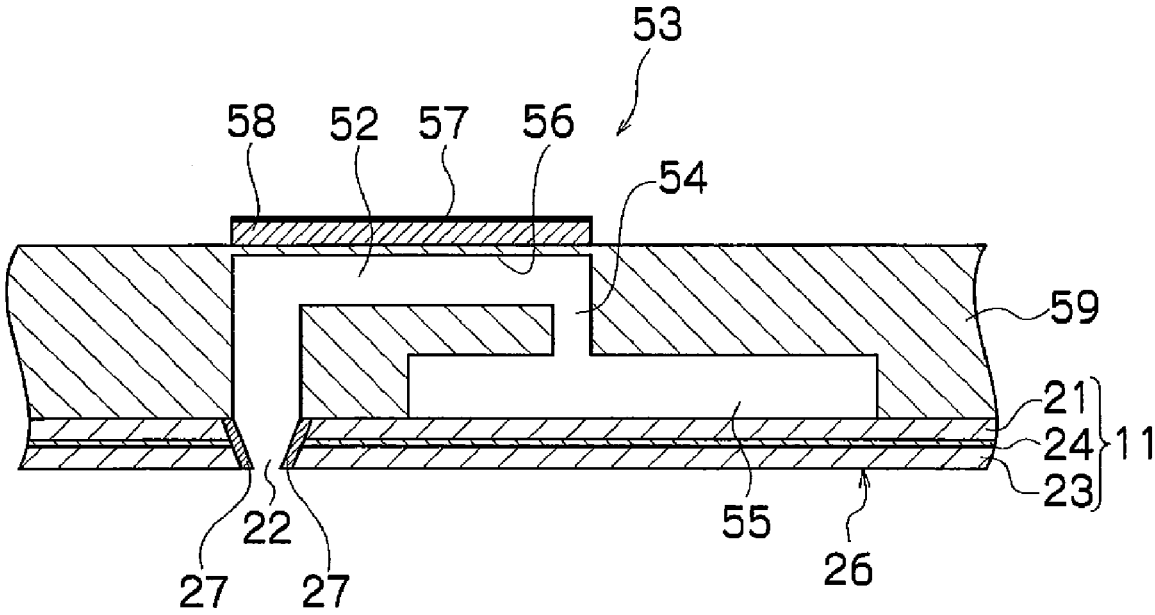
FIG. 7 is a cross-sectional view along line 7-7 in FIG. 6A.

FIG. 6A is a perspective plan view showing an embodiment of the configuration of the head 50, FIG. 6B is an enlarged view of a portion thereof, FIG. 6C is a perspective plan view showing another embodiment of the configuration of the head 50, and FIG. 7 is a cross-sectional view taken along the line 7-7 in FIGS. 6A and 6B, showing the inner structure of a droplet ejection element (an ink chamber unit for one of the nozzles 22).

The nozzle pitch in the head 50 should be minimized in order to maximize the density of the dots printed on the recording paper. As shown in FIGS. 6A and 6B, the head 50 according to the present embodiment has a structure in which a plurality of ink chamber units (the droplet ejection elements) 53, each including the nozzle 22 having the ink ejection port, a pressure chamber 52 corresponding to the nozzle 22, and the like, are disposed two-dimensionally in the for of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper in a direction substantially perpendicular to the conveyance direction of the recording paper is not limited to the embodiment described above. For example, instead of the configuration in FIG. 6A, as shown in FIG. 6C, a line head having nozzle rows of the length corresponding to the entire width of the recording paper can be formed by arranging and combining, in a staggered matrix, short head modules 50' each having a plurality of nozzles 22 arrayed in a two-dimensional fashion.

As shown in FIGS. 6A and 6B, the planar shape of the pressure chamber 52 provided for each nozzle 22 is substantially a square, and an outlet to the nozzle 22 is disposed at one corner on the diagonal line of the square and an inlet of supplied ink (supply port) 54 is disposed at the other corner on the diagonal line of the square.

The shape of the pressure chamber 52 is not limited to that of the present embodiment and various modes are possible in which the planar shape is a quadrilateral shape (rhombic shape, rectangular shape, or the like), a pentagonal shape, a hexagonal shape, or other polygonal shape, or a circular shape, elliptical shape, or the like.

As shown in FIG. 7, the head 50 is constituted of the nozzle plate 11 and the flow channel substrate 59. The pressure chamber 52, the supply port 54 and a common channel 55, and the like, are formed in the flow channel substrate 59. Each pressure chamber 52 is connected to the common channel 55 through the supply port 54. The common channel 55 is connected to an ink tank (not shown), which is a base tank that supplies ink, and the ink supplied from the ink tank is delivered through the common channel 55 to the pressure chambers 52.

An actuator 58 provided with an individual electrode 57 is bonded to a pressure plate (a diaphragm that also serves as a common electrode) 56, which forms the surface of one portion (the ceiling in FIG. 7) of the pressure chambers 52. When a drive voltage is applied to the individual electrode 57 and the common electrode, the actuator 58 deforms, thereby changing the volume of the pressure chamber 52. This causes a pressure change that results in the ink being ejected from the nozzle 22. For the actuator 58, it is possible to adopt a piezoelectric element using a piezoelectric body, such as lead zirconate titanate, barium titanate, or the like. When the displacement of the actuator 58 returns to its original position after ejecting the ink, the pressure chamber 52 is replenished with new ink from the common channel 55 through the independent supply port 54.

Figure 8:
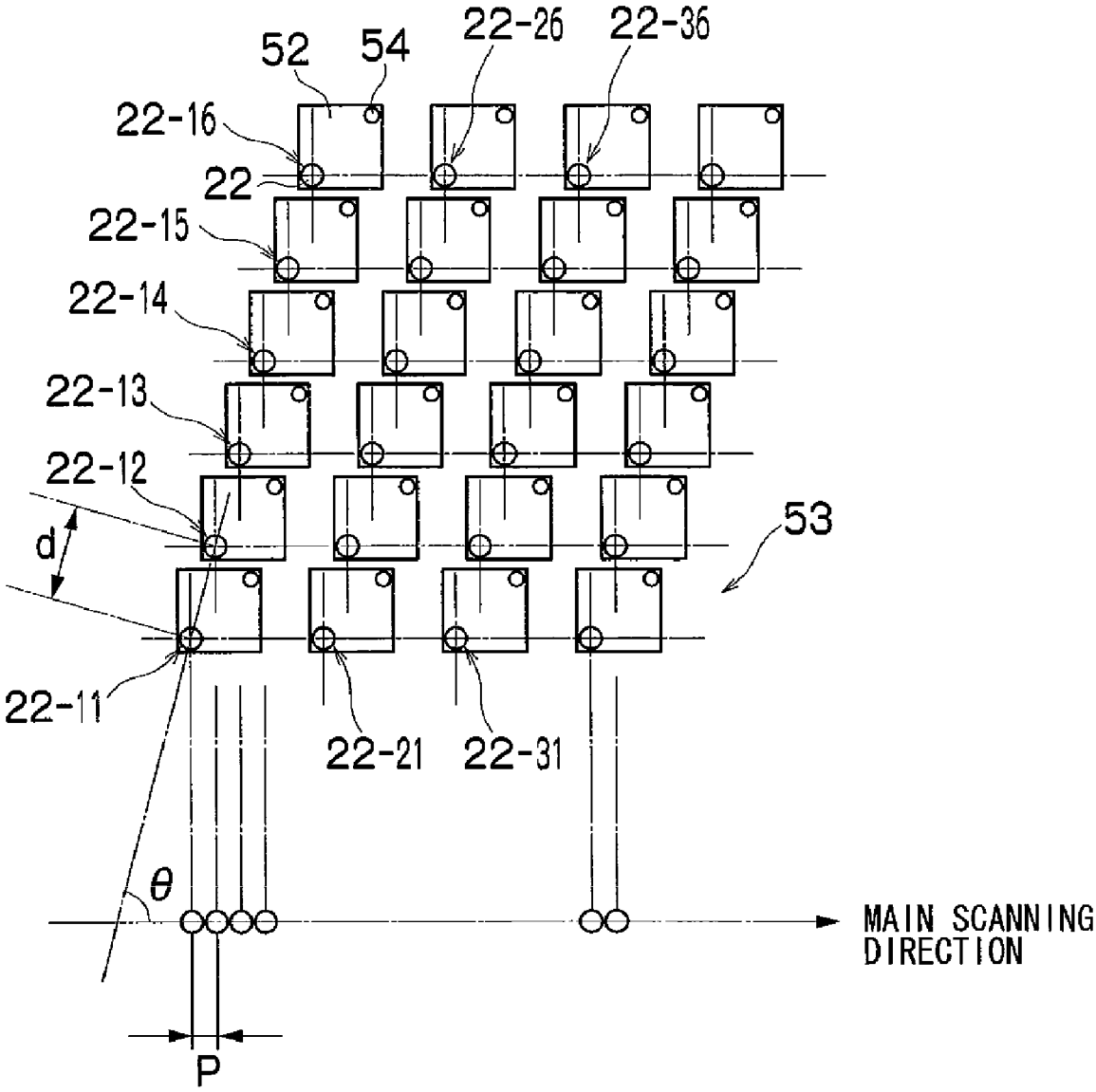
FIG. 8 is a detailed diagram showing an enlarged view of a portion of the print head illustrated in FIGS. 6A and 6B.

As shown in FIG. 8, the high-density nozzle head according to the present embodiment is achieved by arranging the ink chamber units 53 having the above-described structure in a lattice fashion based on a fixed arrangement pattern, in a row direction that coincides with the main scanning direction, and a column direction that is inclined at a fixed angle of θ with respect to the main scanning direction, rather than being perpendicular to the main scanning direction.

More specifically, by adopting a structure in which the ink chamber units 53 are arranged at a uniform pitch d in line with the direction forming the angle of θ with respect to the main scanning direction, the pitch P of the nozzles projected so as to align in the main scanning direction is $d \times \cos\theta$, and hence the nozzles 22 can be regarded to be equivalent to those arranged linearly at the fixed pitch P along the main scanning direction. Such configuration results in the nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 22 arranged in a matrix such as that shown in FIG. 8 are driven, the main scanning according to the above-described (3) is preferred. More specifically, the nozzles 22-11, 22-12, 22-13, 22-14, 22-15 and 22-16 are treated as a block (additionally; the nozzles 22-21, . . . , 22-26 are treated as another block; the nozzles 22-31, . . . 22-36 are treated as another block; . . . ); and one line is printed in the width direction of the recording paper by sequentially driving the nozzles 22-11, 22-12, . . . , 22-16 in accordance with the conveyance velocity of the recording paper.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper is called the sub-scanning direction and the direction perpendicular to same is called the main scanning direction.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Composition of Inkjet Recording Apparatus

Next, an inkjet recording apparatus is described as an embodiment of the application of an image recording apparatus having the head described above.

Figure 9:
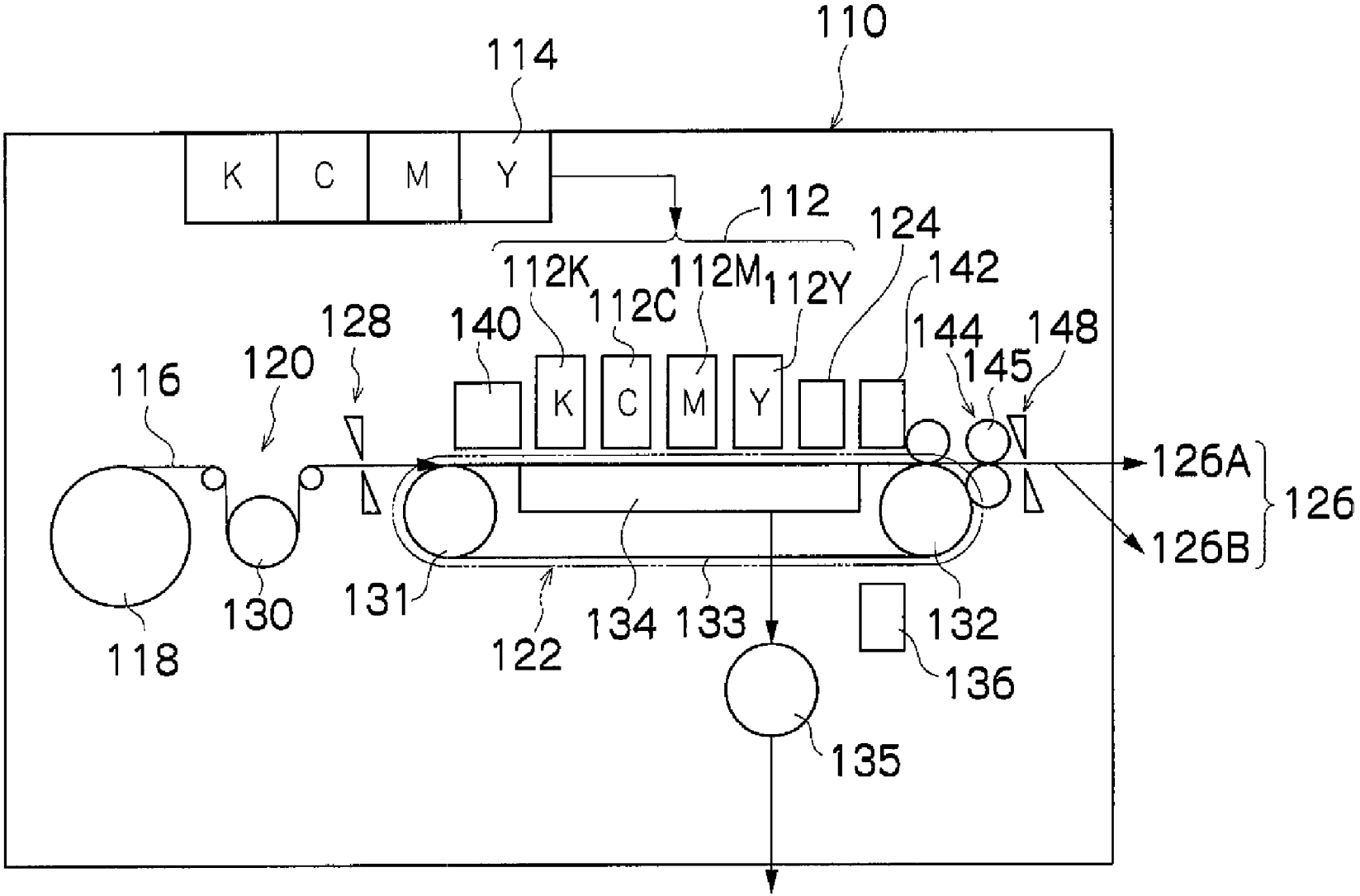
FIG. 9 is a general schematic drawing of an inkjet recording apparatus forming an image forming apparatus according to an embodiment of the present invention.

FIG. 9 is a general schematic drawing of an image processing apparatus which forms one embodiment of an image recording apparatus relating to the present invention. As shown in FIG. 9, the inkjet recording apparatus 110 includes: a print unit 112 having the heads 112K, 112C, 112M, and 112Y provided for ink colors of black (K), cyan (C), magenta (M), and yellow (Y), respectively; an ink storing and loading unit 114 for storing the inks to be supplied to the heads 112K, 112C, 112M and 112Y; a paper supply unit 118 for supplying recording paper 116 forming a recording medium; a decurling unit 120 for removing curl in the recording paper 116; a belt conveyance unit 122, disposed facing the ink ejection face of the print unit 112, for conveying the recording paper 116 while keeping the recording paper 116 flat; a print determination unit 124 for reading the printed result produced by the print unit 112; and a paper output unit 126 for outputting recorded recording paper (printed matter) to The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels.

It is also possible to provide a liquid negative pressure apparatus which applies a negative pressure to the ink inside the nozzles 22, in order to prevent the ink from leaking out from the nozzles 22 provided in the respective heads 112K, 112C, 112M and 112Y when not performing ejection. In this liquid negative pressure apparatus, in order to apply a negative pressure, a negative pressure generating chamber is provided, in the ink storing and loading unit 114 which is connected to the nozzles 22 (for example, an ink cartridge, an ink tank or a sub tank), in order to generate a negative pressure by adjusting the pressure through supplying or evacuating air by means of a pump (not shown).

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of a configuration in which roll paper is used, a cutter (first cutter) 128 is provided as shown in FIG. 9, and the roll paper is cut to a desired size by the cutter 128.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the ink ejection face 26 of the print unit 112 and the sensor face of the print determination unit 124 forms a horizontal plane (flat plane).

Figure 10:
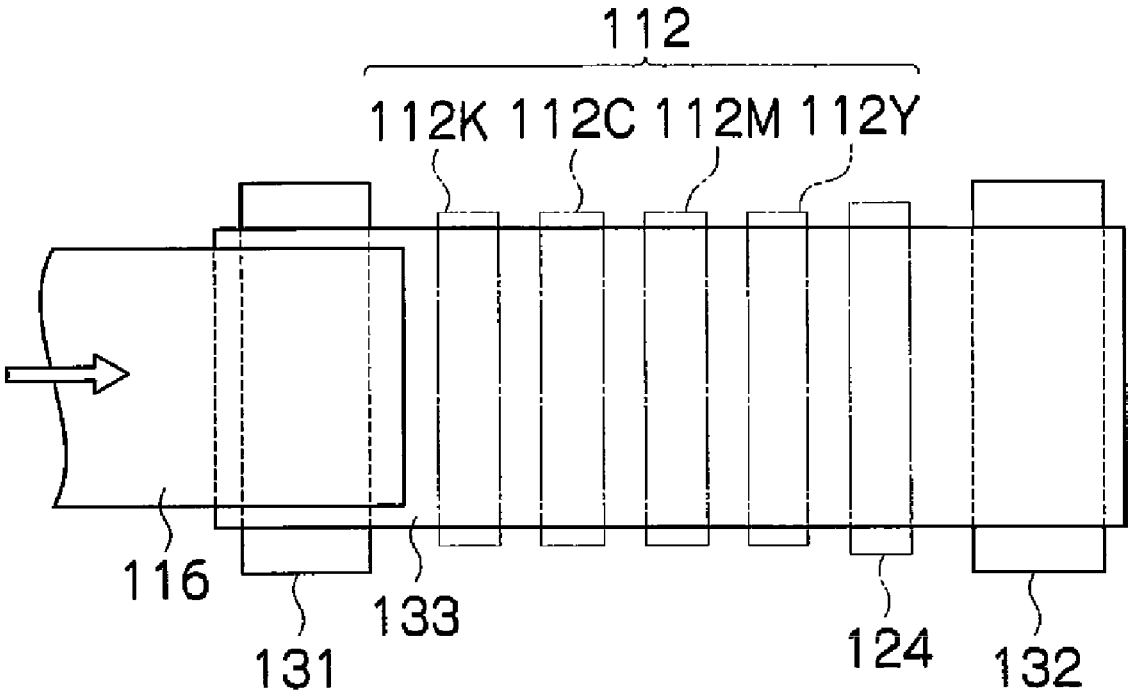
FIG. 10 is a plan view of the principal part of the peripheral area of a print unit in the inkjet recording apparatus illustrated in FIG. 9.

The belt 133 has a width that is greater than the width of the recording paper 116, and a plurality of suction apertures (not shown) are formed on the belt surface. A suction chamber 134 is disposed in a position facing the sensor surface of the print determination unit 124 and the ink ejection face 26 (see FIG. 7) of the print unit 112 on the interior side of the belt 133, which is set around the rollers 131 and 132, as shown in FIG. 10. The suction chamber 134 provides suction with a fan 135 to generate a negative pressure, and the recording paper 116 is held on the belt 133 by suction.

The belt 133 is driven in the clockwise direction in FIG. 9 by the motive force of a motor 88 (shown in FIG. 11) being transmitted to at least one of the rollers 131 and 132, which the belt 133 is set around, and the recording paper 116 held on the belt 133 is conveyed from left to right in FIG. 9.

Since ink adheres to the belt 133 when a marginless print job or the like is performed, a belt-cleaning unit 136 is disposed in a predetermined position (a suitable position outside the printing area) on the exterior side of the belt 133.

A heating fan 140 is disposed on the upstream side of the print unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

The heads 112K, 112C, 112M and 112Y of the print unit 112 are full line heads having a length corresponding to the maximum width of the recording paper 116 used with the inkjet recording apparatus 110, and comprising a plurality of nozzles for ejecting ink arranged on a ink ejection face 26 through a length exceeding at least one edge of the maximum-size recording medium (namely, the full width of the printable range) (see FIG. 10).

The print heads 112K, 112C, 112M and 112Y are arranged in color order (black (K), cyan (C), magenta (M), yellow (Y)) from the upstream side in the feed direction of the recording paper 116, and these respective heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the fill line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the print unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. Furthermore, there are no particular restrictions of the sequence in which the heads of respective colors are arranged.

The print determination unit 124 shown in FIG. 9 has an image sensor (line sensor or area sensor) for capturing an image of the ink-droplet deposition result of the print unit 112, and functions as a device to check for ejection defects such as clogs, landing position error, and the like, of the nozzles, from the ink-droplet ejection results evaluated by the image sensor.

A CCD area sensor in which a plurality of photoreceptor elements (photoelectric transducers) are arranged two-dimensionally on the light receiving surface is suitable for use as the print determination unit 124 of the present example. An area sensor has an imaging range which is capable of capturing an image of at least the full area of the ink ejection width (image recording width) of the respective heads 112K, 112C, 112M and 112Y.

A post-drying unit 142 is disposed following the print determination unit 124. The post-drying unit 142 is a device to dry the printed image surface, and includes a heating fan, for example.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148.

Description of Control System

Figure 11:
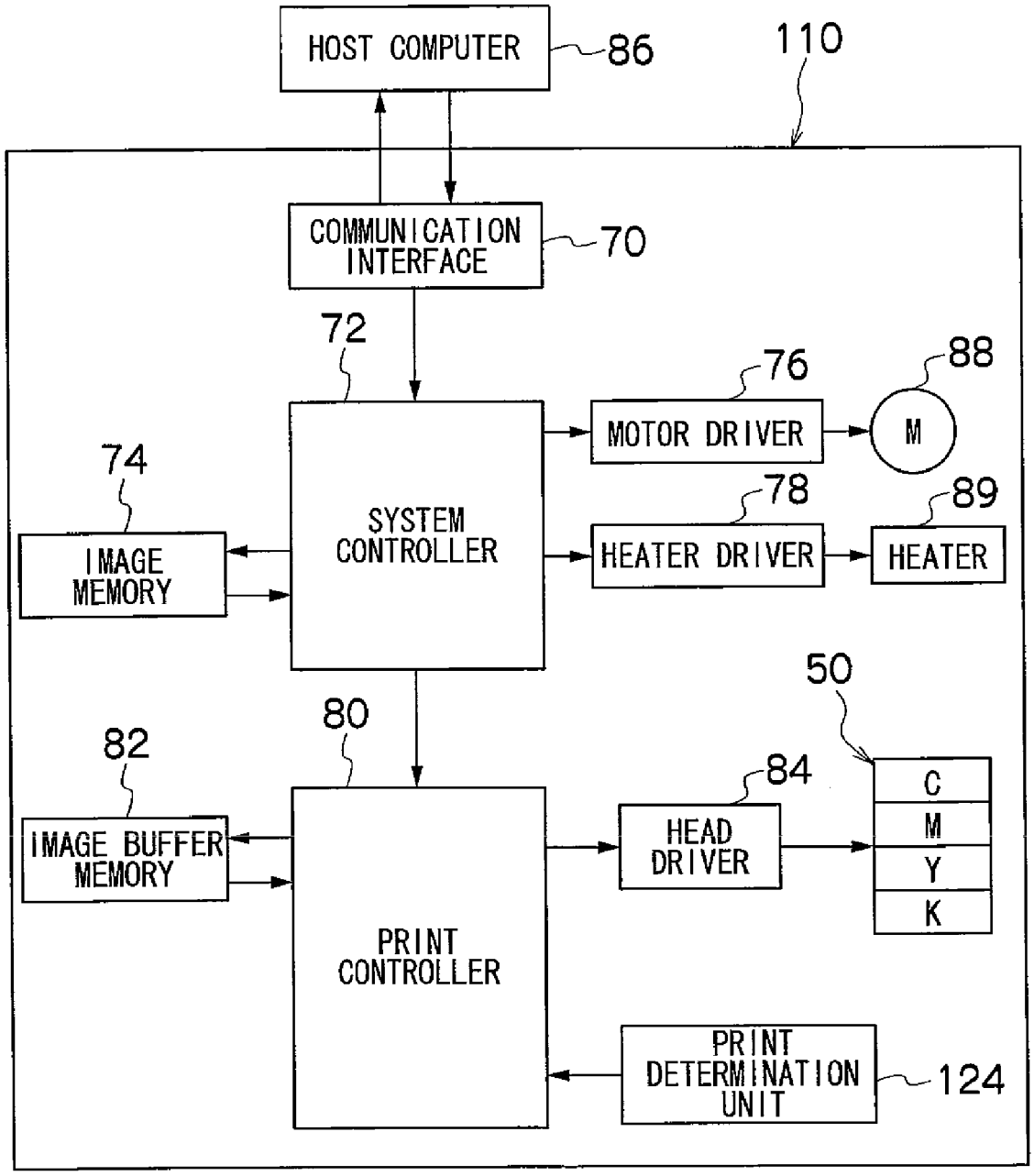
FIG. 11 is a principal block diagram showing the system configuration of the inkjet recording apparatus according to the present embodiment.

FIG. 11 is a block diagram showing the system configuration of the inkjet recording apparatus 110. As shown in FIG. 11, the inkjet recording apparatus 110 includes a communication interface 70, a system controller 72, an image memory 74, a motor driver 76, a heater driver 78, a print controller 80, an image buffer memory 82, a head driver 84, and the like.

The communication interface 70 is an interface unit (image input unit) which functions as an image input device for receiving image data sent from a host computer 86. A serial interface such as USB (Universal Serial Bus), IEEE1394, Ethernet (registered trademark), wireless network, or a parallel interface such as a Centronics interface may be used as the communication interface 70.

The image data sent from the host computer 86 is received by the inkjet recording apparatus 110 through the communication interface 70, and is temporarily stored in the image memory 74. The image memory 74 is a storage device for storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver (drive circuit) 78 drives the heater 89 of the post-drying unit 142 or the like in accordance with commands from the system controller 72.

The print controller 80 is a control unit which functions as a signal processing device for performing various treatment processes, corrections, and the like, in accordance with the control implemented by the system controller 72, in order to generate a signal for controlling droplet ejection from the image data (multiple-value input image data) in the image memory 74, as well as functioning as a drive control device which controls the ejection driving of the head 50 by supplying the ink ejection data thus generated to the head driver 84.

The print controller 80 is provided with the image buffer memory 82; and image data, parameters, and other data are temporarily stored in the image buffer memory 82 when image data is processed in the print controller 80. The aspect shown in FIG. 11 is one in which the image buffer memory 82 accompanies the print controller 80; however, the image memory 74 may also serve as the image buffer memory 82. Also possible is an aspect in which the print controller 80 and the system controller 72 are integrated to form a single processor.

To give a general description of the sequence of processing from image input to print output, image data to be printed is input from an external source via a communications interface 70, and is accumulated in the image memory 74. At this stage, multiple-value RGB image data is stored in the image memory 74, for example.

The head driver 84 outputs a drive signal for driving the actuators 58 corresponding to the nozzles 22 of the head 50 in accordance with the print contents, on the basis of the ink ejection data and the drive waveform signals supplied by the print controller 80. A feedback control system for maintaining constant drive conditions in the head may be included in the head driver 84.

By supplying the drive signals output by the head driver 84 to the head 50, ink is ejected from the corresponding nozzles 24. By controlling ink ejection from the heads 50 in synchronization with the conveyance velocity of the recording paper 116, an image is formed on the recording paper 116.

As described above, the ejection volume and the ejection timing of the ink droplets from the respective nozzles are controlled via the head driver 84, on the basis of the ink ejection data generated by implementing prescribed signal processing in the print controller 80, and the drive signal waveform. By this means, prescribed dot sizes and dot positions can be achieved.

The print determination unit 124 is a block that includes the image line sensor as described above with reference to FIG. 9, reads the image printed on the recording paper 116, determines the print conditions (presence of the ejection, variation in the dot formation, optical density, and the like) by performing desired signal processing, or the like, and provides the determination results of the print conditions to the print controller 80 and system controller 72.

The print controller 80 implements various corrections with respect to the head 50, on the basis of the information obtained from the print determination unit 124, according to requirements, and it implements control for carrying out cleaning operations (nozzle restoring operations), such as preliminary ejection, suctioning, or wiping, as and when necessary.

The nozzle plate, the method of manufacturing the nozzle plate, the ink ejection head and the image forming apparatus according to the present invention have been described in detail above, it should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A nozzle plate comprising:

a silicon plate substrate;

a silicon oxide layer which is formed on the silicon plate substrate, wherein the silicon oxide layer is formed by oxidizing a silicon surface of the silicon plate substrate;

a liquid repelling layer which is formed on the silicon oxide layer;

a nozzle which is formed through the silicon plate substrate, the silicon oxide layer and the liquid repelling layer, wherein ink is ejected through an ejection port of the nozzle in the liquid repelling layer; and a p-type doped layer which forms a whole perimeter of an edge portion defining an inner perimeter of the ejection port of the nozzle in the liquid repelling layer, and forms a region from the edge portion through a boundary portion between the silicon oxide layer and the liquid repelling layer on an inner surface of the nozzle.

2. The nozzle plate as defined in claim 1, wherein the p-type doped layer has a thickness, from the inner surface of the nozzle, not smaller than 2 μm and not larger than 10 μm.

3. An ink ejection head, comprising the nozzle plate as defined in claim 1.

4. An image forming apparatus, comprising the ink ejection head as defined in claim 3.

* * * * *